US007507067B2

(12) United States Patent
Boening et al.

(10) Patent No.: US 7,507,067 B2
(45) Date of Patent: Mar. 24, 2009

(54) TURBOCHARGER OF VARIABLE TURBINE GEOMETRY

(75) Inventors: Ralf Boening, Reiffelbach (DE); Dietmar Metz, Meckenheim (DE); Dirk Frankenstein, Worms (DE)

(73) Assignee: BorgWarner Inc., Auburn Hills, MI (US)

( * ) Notice: Subject to any disclaimer, the term of this patent is extended or adjusted under 35 U.S.C. 154(b) by 437 days.

(21) Appl. No.: 11/321,300

(22) Filed: Dec. 28, 2005

(65) Prior Publication Data

US 2006/0140751 A1 Jun. 29, 2006

(30) Foreign Application Priority Data

Dec. 28, 2004 (EP) ..... 04030888

(51) Int. Cl.
*F04D 29/56* (2006.01)

(52) U.S. Cl. ..... 415/150; 415/160; 415/134

(58) Field of Classification Search ..... 415/150, 415/160, 163, 164, 165, 134, 136, 138, 139
See application file for complete search history.

(56) References Cited

U.S. PATENT DOCUMENTS

| | | | | |
|---|---|---|---|---|
| 4,702,672 | A * | 10/1987 | Leicht et al. | 415/164 |
| 4,770,603 | A * | 9/1988 | Engels et al. | 415/147 |
| 5,146,752 | A * | 9/1992 | Bruestle | 415/164 |
| 5,207,565 | A * | 5/1993 | Roessler | 415/202 |
| 6,409,483 | B2 * | 6/2002 | Jinnai | 415/164 |

FOREIGN PATENT DOCUMENTS

| | | |
|---|---|---|
| DE | 102 58 466 A1 | 7/2003 |
| EP | 1 236 866 A2 | 9/2002 |
| EP | 1 528 225 A1 | 5/2005 |
| JP | 60169604 | 9/1985 |
| JP | 11062603 | 3/1999 |

* cited by examiner

*Primary Examiner*—Igor Kershteyn
(74) *Attorney, Agent, or Firm*—Warn Partners, P.C.

(57) ABSTRACT

A turbocharger of variable turbine geometry, comprising: a vane bearing ring assembly including a vane bearing ring and a disk which can be fixed to the vane bearing ring for creating a flow channel; and at least one support pin which is connected with a first end to the vane bearing ring and which is welded with a second end to the disk which comprises recesses for the support pin end to be welded, the recesses being surrounded by a heat throttle.

7 Claims, 3 Drawing Sheets

TURBOCHARGER OF VARIABLE TURBINE GEOMETRY

CROSS-REFERENCE TO RELATED APPLICATIONS

This application claims priority to European Patent Application No. 04030888.4 filed Dec. 28, 2004. The disclosure of the above application is incorporated herein by reference.

FIELD OF THE INVENTION

The present invention relates to a turbocharger of variable turbine geometry (VTG).

BACKGROUND OF THE INVENTION

The VTG cartridge of such a turbocharger as known from EP 1 236 866 A consists of a guide apparatus comprising vanes and levers and a disk at the turbine casing side. The disk is fixed to a vane bearing ring of a vane bearing assembly in generic turbochargers by means of screws or by welding. To be able to set a defined width for the flow channel which is formed between vane bearing ring and disk and in which the vanes of VTG are positioned, spacer sleeves are needed which in the case of a welded joint can be removed again after welding. Welding, however, may distort the disk due to rigid heat introduction. A distortion of the disk may lead to a jamming of the vanes due to the gap reduction which is locally caused thereby between vanes and disk.

It is therefore the object of the present invention to provide a turbocharger in which it is possible to form a welded joint which connects the disk to the vane bearing ring, if possible, without any distortion, resulting in a constantly uniform spacing as in the case of a connection by means of screws.

SUMMARY OF THE INVENTION

In accordance with the present invention, there is provided a vane bearing ring assembly for a VTG turbocharger. The vane bearing ring assembly includes a vane bearing ring and a disk which can be fixed to vane bearing ring for forming a flow channel. At least one support pin is connected with a first end to the vane bearing ring and a second end welded to the disk.

To avoid undesired distortion of the disk during welding, a heat throttle is provided in a particularly preferred embodiment, the heat throttle surrounding the recess for the support pin ends to be welded.

In a particularly preferred embodiment, said heat throttle is configured as a groove which runs around the recess for the support pin end to be welded.

Thanks to the provision of such a heat throttle, the energy input into the disk can be kept as small as possible. Another advantage of said heat throttle must be seen in the fact that since less energy is discharged into the material of the disk which surrounds the welded joint, i.e. the energy remains "trapped" at the welded joint, less welding energy is needed on the whole for welding the disk material.

The first end of the support pins can be screwed, riveted or fixed in another manner to the disk.

The support pins have preferably a very small diameter of a few millimeters, so that the reduction caused thereby in the flow cross-section, as well as the associated flow swirls, remain minimal.

Further details, advantages and features of the present invention become apparent from the following description of embodiments with reference to the attached drawing, in which:

DETAILED DESCRIPTION OF THE PREFERRED EMBODIMENTS

Figure 1:
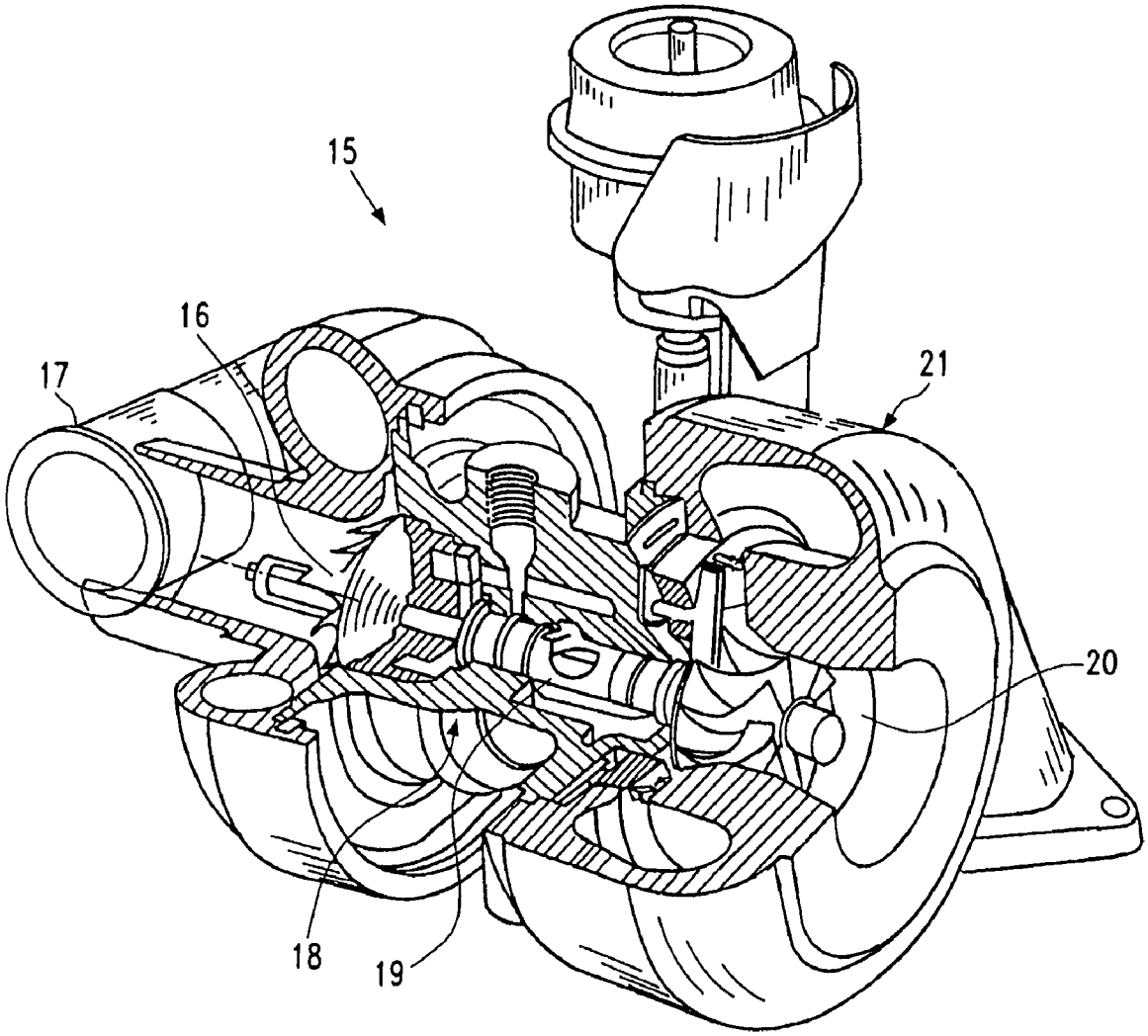
FIG. 1 is a perspective view of a turbocharger according to the invention.

Since a complete illustration of all constructional details of a turbocharger of variable turbine geometry is not needed for the following description of the constructional principles of the invention, FIG. 1 only shows the basic components of a turbocharger 15 according to the invention, the turbocharger 15 comprising a compressor impeller 16 in a compressor housing 17, a bearing housing 18 with the necessary bearings for the shaft 19, and a turbine wheel 20 in a turbine casing 21 in the standard manner. The remaining parts are not needed for explaining the present invention for illustrating all of the principles thereof, but said parts are of course provided.

Figure 2:
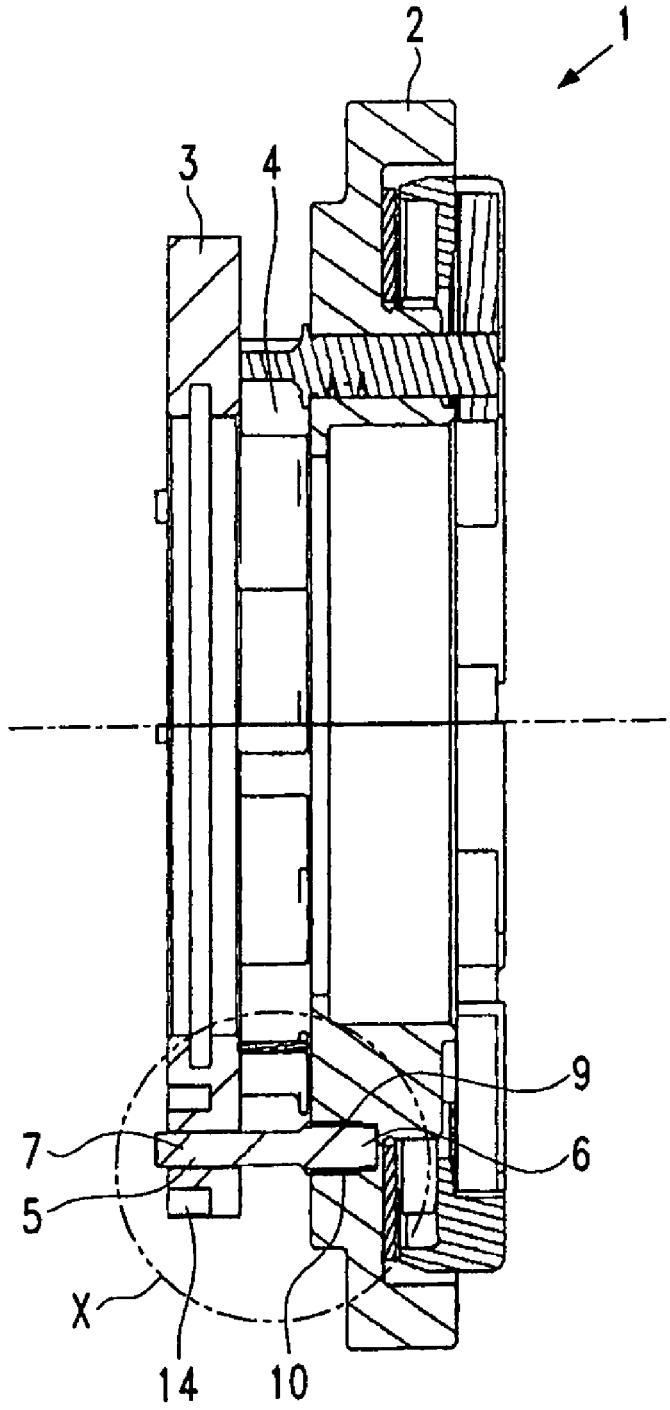
FIG. 2 is a sectional view showing a vane bearing assembly of the invention for the turbocharger according to the invention.

Hence, FIG. 2 only shows a vane bearing assembly 1 of a turbocharger according to the invention. The vane bearing assembly 1 comprises a vane bearing ring 2 on which a disk 3 is arranged at a defined distance. The disk 3 is preferably made from the same material as the vane bearing ring 2 and serves, as has been stated, to set an exact axial gap for defining a flow channel 4.

For the fixation of the disk 3 to the vane bearing ring 2, at least one support pin, but normally a plurality of support pins are provided, of which a support pin 5 is visible in FIG. 2. The support pin 5 comprises a first and a second end 6 and 7, respectively. In the mounted state a shaft portion 8 which is arranged in the flow channel 4 is disposed between the ends 6 and 7.

As follows from a joint study of FIGS. 2 and 3, end 6 in the illustrated example comprises an external thread 9 which cooperates with a corresponding internal thread 10 of the vane bearing ring 2 for fixing said first end 6 to the vane bearing ring 2.

Figure 3:
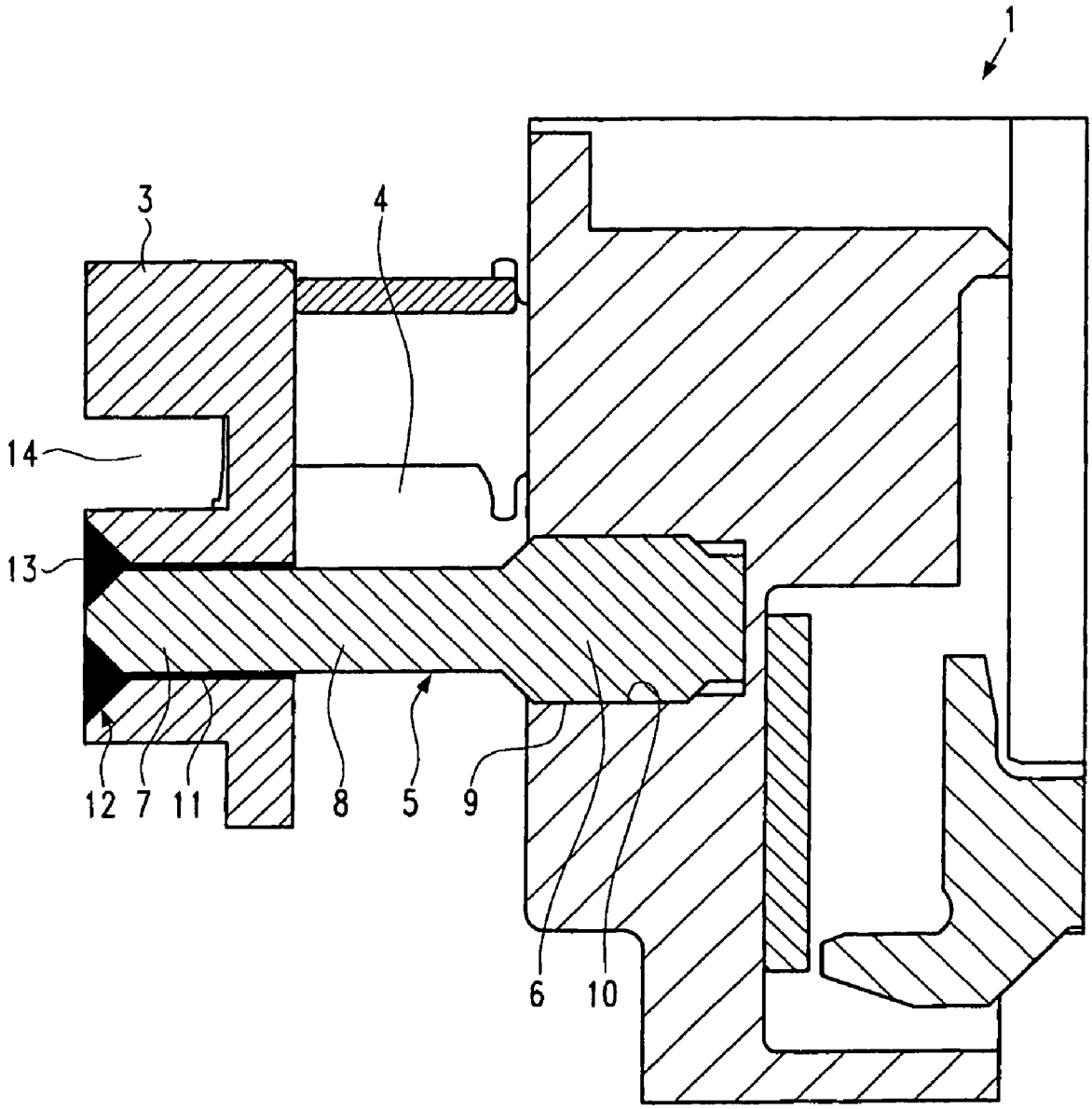
FIG. 3 shows detail X of FIG. 2 on an enlarged scale.

As becomes particularly apparent from the enlarged illustration of FIG. 3, the second end 7 of the support pin 6 is arranged in a recess 11 of the disk 3 and is connected in a conically expanded portion 12 of the recess 11 to the disk 3 via a weld 13. For this purpose end 7 is tapered on its face in the manner of a roof so as to obtain a perfect weld 13.

In the particularly preferred embodiment which is shown in FIGS. 2 and 3, a heat throttle is provided around the recess 11 of disk 3 in the form of a surrounding groove 14 which prevents heat from directly penetrating into the solid part of the disk 3, which helps to avoid distortion of the disk 3 during welding and additionally reduces the necessary amount of welding energy to be input.

According to the method of the invention, the disk 3 is provided with a corresponding recess 11 per support pin 5 for producing a vane bearing ring assembly of the invention, as has been described above, together with the standard production steps for the vane bearing ring 2, the vane shafts, levers and other parts that are normally provided, the above-described heat throttle being mounted around each of said recesses 11 in the form of the surrounding groove 14.

Subsequently, for the fixation of the disk 3 to the vane bearing ring 2 the first end 6 of the support pin 5 is first screwed to the vane bearing ring 2. Spacer bodies (not shown in more detail in the drawing) are then inserted between vane bearing ring 2 and disk 3 to adjust the defined distance between the vane bearing ring 2 and the disk 3. The second end 7 is then welded and the spacer body is removed.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A turbocharger of variable turbine geometry, comprising:

a vane bearing ring assembly including a vane bearing ring and a disk which can be fixed to the vane bearing ring for creating a flow channel;

at least one support pin which is connected with a first end to the vane bearing ring and which is welded with a second end to the disk, wherein the disk comprises one recess per support pin for the support pin end to be welded, said recess being surrounded by a heat throttle configured as a groove running around the recess.

2. The turbocharger according to claim 1, wherein the first end of the support pin is provided with an external thread.

3. The turbocharger according to claim 1, wherein the support pin comprises a shaft section between the first and second end which is tapered in the outer diameter.

4. A vane bearing ring assembly for a turbocharger of variable turbine geometry, comprising:

a vane bearing ring and a disk which can be fixed to the vane bearing ring for creating a flow channel;

at least one support pin which is connected with a first end to the vane bearing ring and which is welded with a second end to the disk, wherein the first end of the support pin is provided with an external thread; and a heat throttle mounted in the disk in the form of a groove running around the recess.

5. The vane bearing ring assembly according to claim 4, wherein the first end of the support pin is screwed to the vane bearing ring.

6. A method for producing a vane bearing ring assembly for a turbocharger of variable turbine geometry, comprising:

providing a vane bearing ring and a disk which can be fixed to the vane bearing ring for creating a flow channel, providing at least one support pin and connecting said pin at a first end to the vane bearing ring and welding said pin at a second end to the disk; and providing a heat throttle mounted in the disk in the form of a groove running around the recess.

7. The vane bearing ring assembly according to claim 6, wherein the first end of the support pin is screwed to the vane bearing ring.

* * * * *